United States Patent [19]

van Leeuwen

[11] 4,403,168

[45] Sep. 6, 1983

[54] HIGH-VOLTAGE ELECTRODE CONSISTING OF A PLURALITY OF SERIES-CONNECTED SINGLE ELECTRODES FOR A SPARK-DISCHARGE DEVICE

[76] Inventor: Peter van Leeuwen, Rudolf-Diesel-Strasse 4, 8060 Dachau, Fed. Rep. of Germany

[21] Appl. No.: 295,148

[22] Filed: Aug. 21, 1981

[30] Foreign Application Priority Data

Aug. 25, 1980 [DE] Fed. Rep. of Germany ..... 8022613

[51] Int. Cl.[3] ..... H01J 1/16

[52] U.S. Cl. ..... 313/336; 313/351; 204/164; 422/907; 425/174.8 E

[58] Field of Search ..... 313/336, 351; 55/152; 430/937; 174/127; 425/174.8 R, 174.8 E; 427/35; 422/186.21, 180.4, 907; 204/164, 165, 168

[56] References Cited

U.S. PATENT DOCUMENTS

| | | | |
|---|---|---|---|
| 2,252,694 | 8/1941 | Bennett | 313/351 |
| 3,405,052 | 10/1968 | Schirmer | 422/907 |
| 4,239,973 | 12/1980 | Kolbe et al. | 425/174.8 E |
| 4,298,440 | 11/1981 | Hood | 425/174.8 E |

*Primary Examiner*—Harold A. Dixon

*Attorney, Agent, or Firm*—Schuyler, Banner, Birch, McKie & Beckett

[57] ABSTRACT

A high voltage electrode for a spark discharge device used in cooperation with an opposing roller electrode to roughen plastic sheets. The electrode is formed of a multiplicity of plates, or platelets, aligned edge to edge to form together a knife edge. Individual platelets are removable from an active position, within a holder, to an active position, on a selectable basis. Thereby, the portion of the plastic sheet to be roughened can readily be controlled.

2 Claims, 2 Drawing Figures

HIGH-VOLTAGE ELECTRODE CONSISTING OF A PLURALITY OF SERIES-CONNECTED SINGLE ELECTRODES FOR A SPARK-DISCHARGE DEVICE

DISCLOSURE OF INVENTION

The invention relates to a high-voltage electrode for a spark-discharge device for roughening sheet-like plastic layers, consisting of a plurality of series-connected single electrodes and having the form of a knife electrode which faces a counterelectrode consisting of a roller or a plate.

An arrangement with a knife electrode and a roller to generate a spark discharge for roughening sheet-like plastic layers is known and described in Unexamined German Patent Application No. 73 28 009.8. In addition, it is common practice to subdivide the knife electrode into separate single electrodes lying close to one another and capable of being pivoted out of this plane. By pivoting out the single electrodes, they are brought closer to the roller so that the spark discharge develops in the area of these swung-out single electrodes. This measure is intended to limit the roughening of sheet-type plastic layers to specified strips of the plastic layer which are determined by the pivoting out of the single electrodes.

A primary object of the invention is to simplify the design of the presently known knife electrode which is subdivided into single electrodes. According to the teachings of the invention, this object is achieved by shaping the single electrodes like platelets and combining them into a row in such a way that the platelets essentially fall into one plane, each platelet being retained in a slot of a holder which, for each platelet, is provided with at least one spring-loaded ball catch, with the ball engaging in one or more countersunk holes of the particular platelets concerned and the countersunk holes lying on the platelets on a line perpendicular to the holder.

Because the single electrodes are designed as platelets, it is possible to clamp them in simple fashion in the slot of the holder while lying in one plane, and as a result of the locking by means of the ball catches and the countersunk holes on the platelets, the latter can readily be pulled from a rearward position in which the ball catches lock into one countersunk hole, during which the platelets reach a pulled-up position in which, by means of the ball catch, they engage in another countersunk hole. In this pulled-up position, the platelets form a knife electrode which is shorter than the whole electrode, but the pulled-out platelets lie with their spark-discharge emitting end faces in one line.

BRIEF DESCRIPTION OF DRAWINGS

The figures show one embodiment of the invention.

BEST MODE FOR CARRYING OUT THE INVENTION

Figure 1:
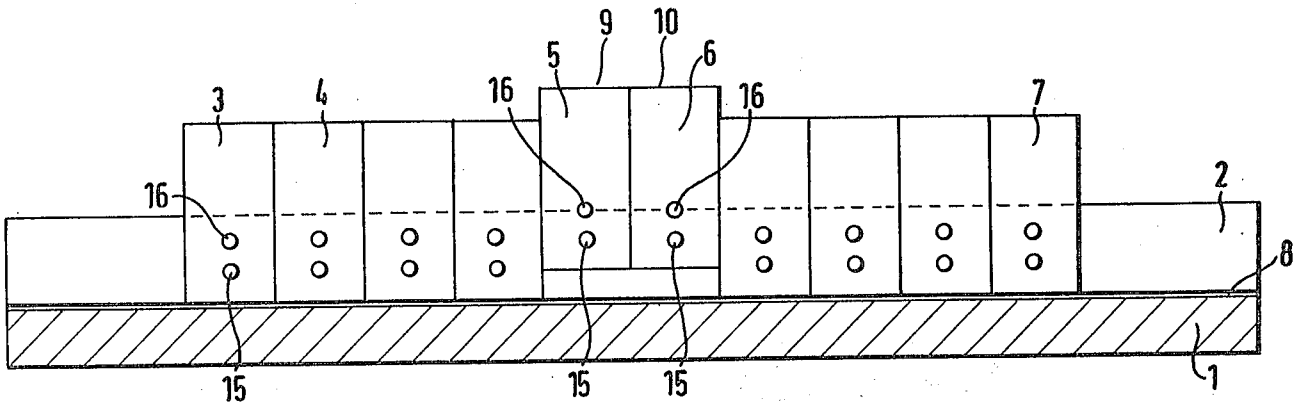
FIG. 1 is a sectional view of the holder taken along line I—I of FIG. 2, with the platelets inserted.

In FIG. 1, the holder 1 is shown in section. It is provided with a slot 2 which reaches approximately as far as its middle. The slot reaches so deep into the material of the holder 1 that the platelets 3, 4, etc. inserted thereinto can be securely held by it. The platelets 3, 4 and 7 (as well as other neighboring platelets) are inserted down to the bottom 8 of the slot 2. They are held in the slot in a manner such as shown further below in FIG. 2.

The platelets 5 and 6 have been pulled out of the slot 2 and are secured in this position with regard to their neighboring platelets. The end faces 9 and 10 of the two platelets 5 and 6 form the knife electrode which is active in this case and from which the spark discharge emanates, and which sprays a plastic layer (not shown) which is conducted over a roller (also not shown).

Figure 2:
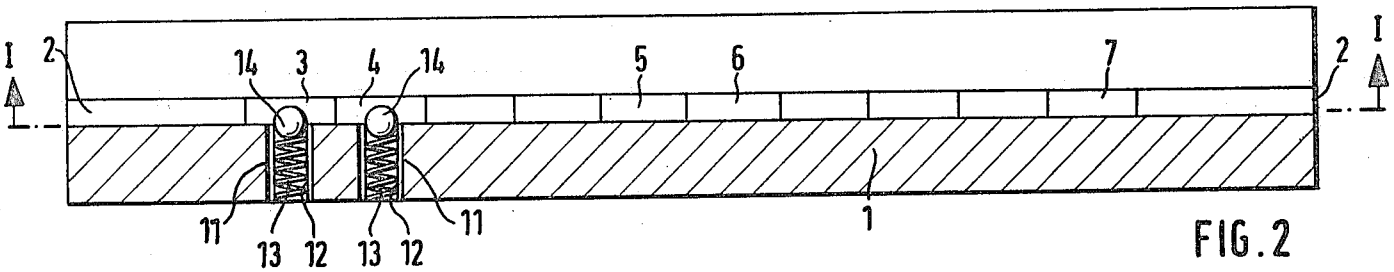
FIG. 2 is a top view, partly in section, of the same holder.

Referring to FIG. 2, the slot 2 in holder 1 carries the platelets shown in FIG. 1. In order to illustrate in FIG. 2 the principle of locking the platelets in position, the particular part of the holder 1 is drawn in section. Here, each platelet 3, 4 has a hole 11 (to simplify the drawing, only two holes are shown) into which a bushing 12 is pressed. The bushing carries in its interior the spring 13 which presses against the ball 14. Through appropriate design of the bushing 12, the ball 14 is prevented from sliding out of the bushing 2. However, the device retaining the bushing 12 is designed so that the ball 14 can extend partially into the slot 2.

As can now be seen from FIG. 1, all the platelets 3, 4, etc., are provided with countersunk holes 15 and 16 which respectively lie on one line and in which the ball 14 can lock into position. In the position of the platelets 3 and 4, the ball 14 engages in the upper countersunk hole 16; in the position of the platelets 5 and 6, the particular ball concerned locks into the lower countersunk position 15. In this way, the platelets 3, 4, etc., are arrested in their two positions shown in FIG. 1.

This design makes it possible to conveniently adapt the knife electrode consisting of single platelets at any time to the particular requirements with respect to the design of the webs to be treated, namely either by pushing the particular platelets concerned out of the slot 2, or pushing them back thereinto. Furthermore, it is possible to cut away from the side material from the platelets in order to be able to prepare a web which is narrower than a platelet. Since the form of the platelet is simple and since it is preferably made from aluminum, such adaptation is quite easy. Subsequently, the platelet thus cut can easily be replaced by a whole platelet, if desired.

I claim:

1. A high voltage electrode consisting of a plurality of series-connected single electrodes for a spark-discharge device for roughening sheet-like plastic layers, having the form of a knife electrode which faces a counterelectrode consisting of a roller or a plane, characterized in that said single electrodes are designed as a multiplicity of separate individual platelets and are combined into a row, with the platelets arranged edgewise in such a manner as to fall essentially into one plane, a holder for holding said platelets in said row normally in a retracted, inoperative position, but with selected platelets in extended operative position.

2. A high-voltage electrode consisting of a plurality of series-connected single electrodes for a spark-discharge device for roughening sheet-like plastic layers, having the form of a knife electrode which faces a counterelectrode consisting of a roller or a plane, characterized in that a multiplicity of said single electrodes are designed as separate individual platelets and are combined into a row in such a manner that said platelets (3, 4, 5, 6, 7) fall essentially into one plane, a holder for holding said platelets in said row, each platelet being retained in a slot (2) of said holder (1), at least one spring-loaded ball catch (12, 13, 14) for each platelet, with the ball (14) engaging in one or more countersunk holes (15, 16) of the particular platelet concerned which lie on said platelet on a line perpendicular to said holder (1).

* * * * *